United States Patent [19]

Lockard

[11] 3,999,287

[45] Dec. 28, 1976

[54] METHOD OF MAKING A SWITCH HAVING A DIODE MOUNTING FEATURE

[75] Inventor: Joseph Larue Lockard, Harrisburg, Pa.

[73] Assignee: AMP Incorporated, Harrisburg, Pa.

[22] Filed: Apr. 20, 1976

[21] Appl. No.: 678,780

Related U.S. Application Data

[62] Division of Ser. No. 556,742, March 10, 1975, Pat. No. 3,974,347.

[52] U.S. Cl. ..... 29/622; 29/628

[51] Int. Cl.[2] ..... H01H 11/00

[58] Field of Search ..... 29/622, 592, 628; 307/247 A, 259, 317; 340/356 C; 200/6 R, 6 B, 6 BA, 6 BB, 6 C, 16 R, 16 D, 16 C, 237, 238, 239, 252, 310, 314, 315, 316, 336, 339, 340

[56] References Cited

UNITED STATES PATENTS

| | | | |
|---|---|---|---|
| 3,194,986 | 7/1965 | Belek et al. | 307/259 |
| 3,504,198 | 3/1970 | Boatman | 307/247 A X |
| 3,588,538 | 6/1971 | Picillo | 307/247 A UX |
| 3,729,600 | 4/1973 | Solomon et al. | 200/16 D |
| 3,746,816 | 7/1973 | Brady | 200/159 A |
| 3,858,012 | 12/1974 | Lockard | 200/16 D |
| 3,878,344 | 4/1975 | Lockard | 200/6 B |
| 3,916,512 | 11/1975 | Sato et al. | 29/622 |

*Primary Examiner*—James R. Dugan
*Attorney, Agent, or Firm*—Gerald K. Kita

[57] ABSTRACT

A manually actuated switch includes a pair of terminals forming switch poles and a knob which is manually actuated to complete or interrupt an electrical circuit across the poles. A pair of spaced contacts are embedded in the knob and resiliently grip therebetween a diode which controls current direction of the completed circuit.

5 Claims, 7 Drawing Figures

METHOD OF MAKING A SWITCH HAVING A DIODE MOUNTING FEATURE

This is a division of application Ser. No. 556,742, filed Mar. 10, 1975, now U.S. Pat. No. 3,974,347.

BACKGROUND OF THE PRIOR ART

The present invention relates to a manually actuated switch and more particularly to a switch compatible with logic level voltages and currents in circuits using solid state circuitry. Design and fabrication of a manually actuated switch of miniature size compatible with solid state logic level voltages on a printed circuit board has been a major advance. Such a switch provides manual selection of circuit elements to be operated. One major drawback to circuit selection is the danger of element destruction if voltages of incorrect polarity or incorrect current direction is switched into a selected solid state circuit element. To prevent such a mishap a manual switch should be provided with a diode to isolate undesired voltages or currents from the circuit selected by switch operation.

BRIEF DESCRIPTION OF THE PREFERRED EMBODIMENT

The present invention relates to a technique for incorporating a diode into an electrical circuit, preferably in a manually actuated switch portion of the circuit. A diode is difficult to assemble in a circuit by automatic processes because of its small size and the need for making permanent electrical connection thereto. A diode is usually provided with electrical leads which are hand soldered to a printed circuit board. The diode leads may or may not be plugged into holes of the circuit board. According to the present invention a lead free or leadless diode is pressed into position between opposed metal contacts which resiliently grip the diode therebetween. The diode is thereby interposed in a circuit path through the contacts and consequently through the diode. After positioning the diode an adhesive or an encapsulant is applied which permanently adheres the diode in place. The gripping contacts are advantageously embedded in a dielectric knob or switch operator.

OBJECTS

It is therefore an object of the present invention to provide a technique for incorporating a diode in an electrical circuit by press fitting a diode between metal contacts and then applying an adhesive to secure the diode permanently in place.

Another object of the present invention is to provide an automatic process for incorporating a diode in a circuit by press fitting a diode between a pair of electrical contacts and subsequently encapsulating the diode permanently in position with the contacts being embedded in a dielectric material.

Another object of the present invention is to provide a manually actuated switch wherein a circuit is selectively completed across a pair of switch poles by a manually actuated operator in the form of a dielectric knob having a pair of electrical contacts embedded therein together with a diode in resilient gripped compression between the contacts.

Other objects and many advantages of the present invention will become apparent from the following detailed description taken in conjunction with the accompanying drawings.

DETAILED DESCRIPTION OF THE PREFERRED EMBODIMENT

Figure 1:
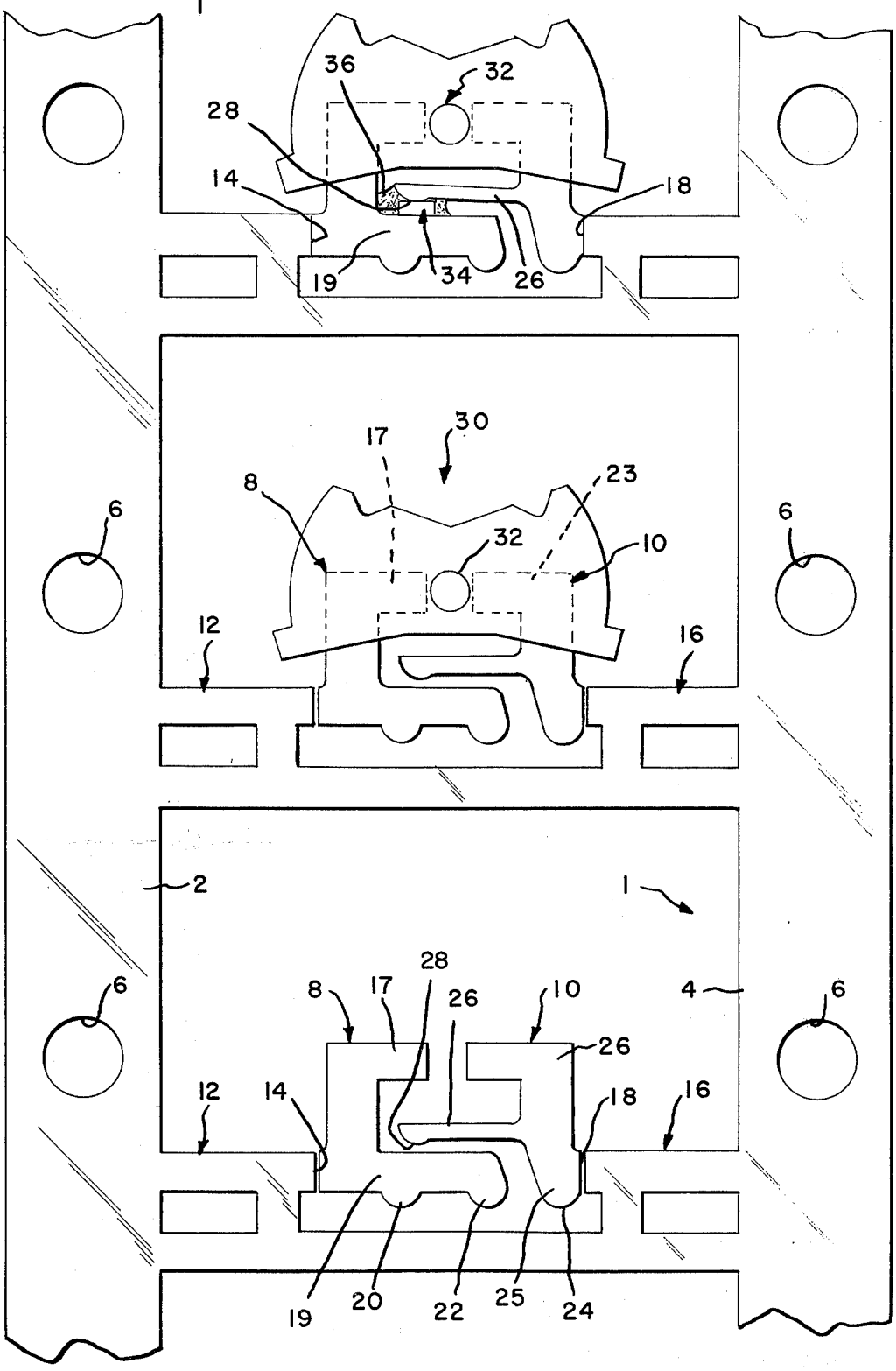
FIG. 1 is an enlarged fragmentary plan view of a carrier strip mounted subassembly utilized in a switch according to the present invention and further illustrating the sequence of fabricating the subassembly.

As shown more particularly in FIG. 1 of the drawings there is shown generally at 1 a ladder type carrier strip having opposed side margins 2 and 4 provided with pilot holes 6 utilized advantageously to advance the carrier strip serially in the well known manner. At prescribed intervals a pair of spaced contacts 8 and 10 are stamped and formed integral with and bridging across the margins portions 2 and 4. More particularly the contact 8 is connected to the margin portion 2 by a stem portion 12 with a line kerf or indented scored portion 14 at the junction of the stem 12 and the contact 8. Similarly the contact 10 is joined by a stem portion 16 to the strip or margin portion 4 with a line kerf or indented scored portion 18 at the junction of the stem portion 16 and the contact 10. As shown the contact 8 is generally C-shaped and includes a bottom portion 19 having a pair of depending integral projecting arcuate portions 20 and 22. The contact 10 is generally of reversed F configuration having a bottom portion 25 and a depending integral projecting arcuate portion 24. The upper portion 23 of the contact 10 is generally of reversed C-shaped configuration and includes an integral projecting cantilever beam 26 which is relatively thin to permit resilient flexing thereof. The end of the beam portion 26 includes an arcuate depending portion 28 which is opposed and relatively cosely spaced from the bottom portion 19 of the contact 8. While the contacts 8 and 10 yet remain on the carrier strip 1 they are advanced serially in a well known manner to another work station where a dielectric knob generally indicated at 30 is secured to the top portions 17 and 23 of the contacts 8 and 10, leaving the bottom portions 19 and 25 and the beam 26 exposed. More particularly the knob 30 may be molded in place thereby embedding the top portions 17 and 23 therein. Alternatively the knob 30 may have the contact portions 17 and 23 inserted therein and adhesively embedded in place. Once the contacts 8 and 10 are embedded in place they will be maintained in their corresponding positions as shown in the figure without a need for the carrier strip stem portions 12 and 16. The knob portion 30 further is provided with a central projecting axle 32 which projects out of opposite sides of the knob 30. Yet with reference to FIG. 1 the carrier strip 1 may be advanced to a further work station whereby a leadless diode generally indicated at 34 is press fitted between the contact portions 28 and 19. More particularly the diode 34 is in the form commonly referred to as a diode chip having electrically conductive opposite sides. When the diode 34 is press fitted into place as shown the beam 26 will be slightly deflected resiliently to apply gripping pressure on the diode. The C shapes of the contacts stiffly resist collapse of the contacts from pressure on the diode. The diode conducting surfaces therefore will be compressibly contacted by the contact portion 28 and by the contact portion 19. The diode will thereby be fixedly mounted in position. Any desired type of inserting machine (not shown) may be utilized to insert the diode since all that is required is merely the press fit insertion of the diode between the contact portions 28 and 19 with no further operation being required. The diode will control current direction of an electrical circuit completed across the diode and through the contact portions 26 and 19. In order to permanently secure the diode 34 in its press fit position a quantity of adhesive or encapsulant material 36 is wiped, sprayed or otherwise applied on the diode 34 and the contact portions 28 and 19. More particularly the encapsulant or adhesive 36 is merely deposited and permanently adheres contact portions 19 and 28 to the outer periphery of the press fit diode 34. As shown sufficient quanity of encapsulant 36 may also be applied to substantially encircle or encapsulate the diode 34 and fill the surrounding clearance between the contact portions 26 and 19. The encapsulant or adhesive may be applied at the same work station whereat the diode is press fit. Alternatively the carrier strip may be advanced to an additional work station subsequent to press fitting of the diode in order to separate application of the encapsulant from the work station at which the diode is assembled. The resulting structure is a subassembly of a knob or operator, for example, having a pair of contacts embedded therein and having a diode bridged electrically across the contacts, with such subassembly being fabricated by an automatic process. Each of the completed assemblies may be separated from the carrier strip 1 by frangibly separating along the kerfs 14 and 18.

Figure 2:
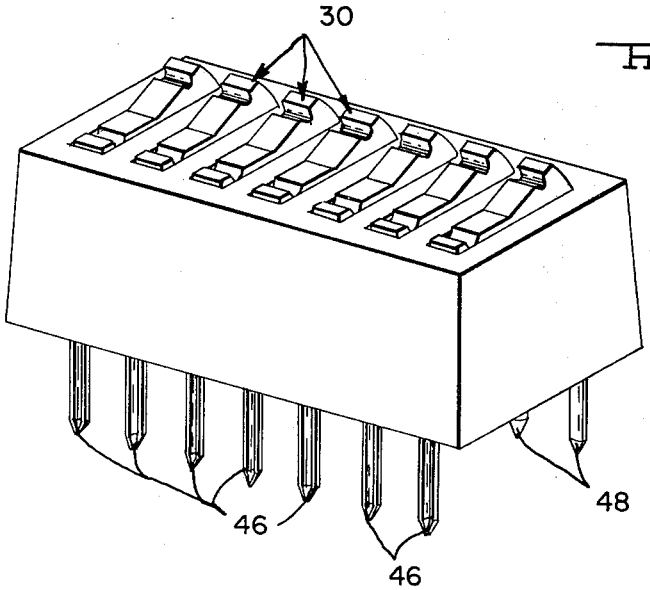
FIG. 2 is an enlarged perspective of a preferred embodiment of the switch according to the present invention.
Figure 3:
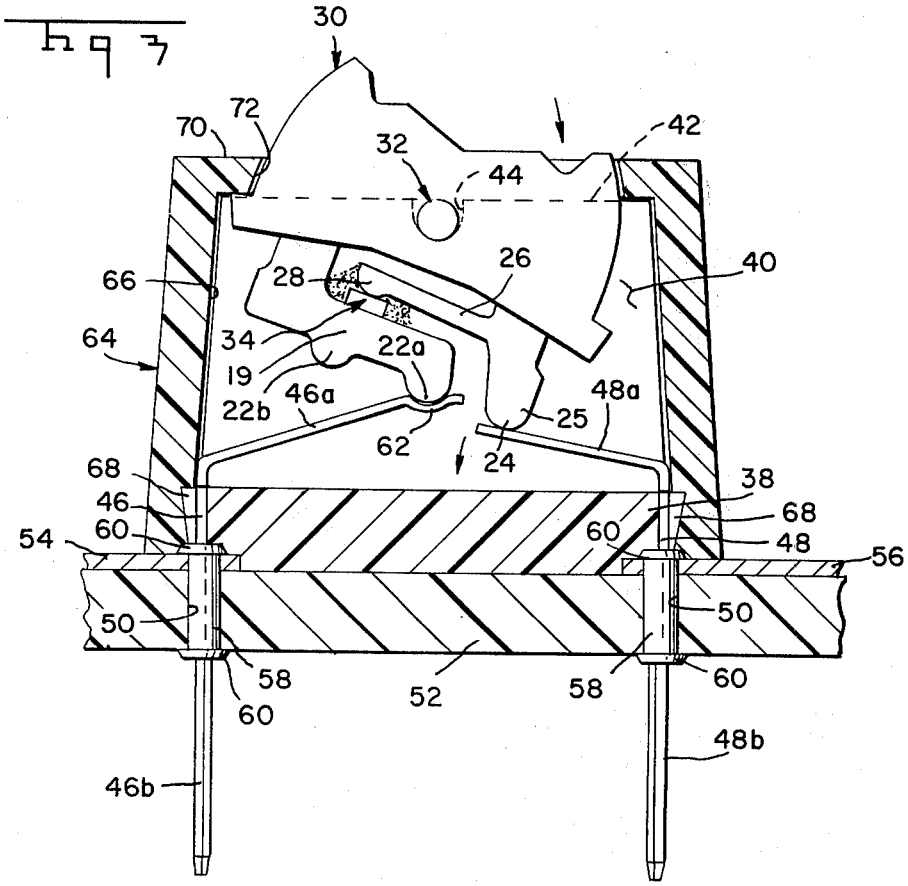
FIG. 3 is an enlarged elevation in section illustrating the switch shown in FIG. 2 mounted on a printed circuit board and illustrating the switch in one mode of operation thereof.

As shown more particularly in FIG. 2 a plurality of subassemblies 30 may be assembled in a series of manually actuated switches. More particularly with reference to FIGS. 2 and 3, an exemplary switch comprises a base portion 38 having a plurality of spaced partitions 40 projecting therefrom. The top of the partitions 42 may be provided with a central recess 44. In practice the axle 32 of each subassembly 30 will bridge across and be supported by two of these partitions 40 with each subassembly accordingly suspended for rotation between a corresponding pair of partitions 40. The base 38 has mounted thereon opposed pairs of contacts 46 and 48. More particularly an opposed corresponding pair of contacts 46 and 48 are mounted on the base and have corresponding end portions 46' and 48' projecting diagonally toward each other in suspended cantilever portion over the base 38. Each opposed pair of contacts portion 46' and 48' are disposed between a pair of partitions 40 together with a subassembly 30. Opposite end portions **46*b* and 48*b* of the terminals 46 and 48 project outwardly of the base 48 in depending relationship therefrom for pluggable connection within apertures 50 of a printed circuit board 52 having circuit paths 54 and 56 thereon. More particularly, solder 58 fill the clearances between the sidewalls of the apertures 50 and the contacts 46*b* and 48*b* inserted therein. The solder 58 also forms solder fillets 60 encircling the terminals 46*b* and 48*b* adjacent the ends of the apertures 50 further serving to solder the terminals to the corresponding circuit paths 54 and 56. Each contact 46*a* includes an arcuately bent end portion 62**.

Figure 4:
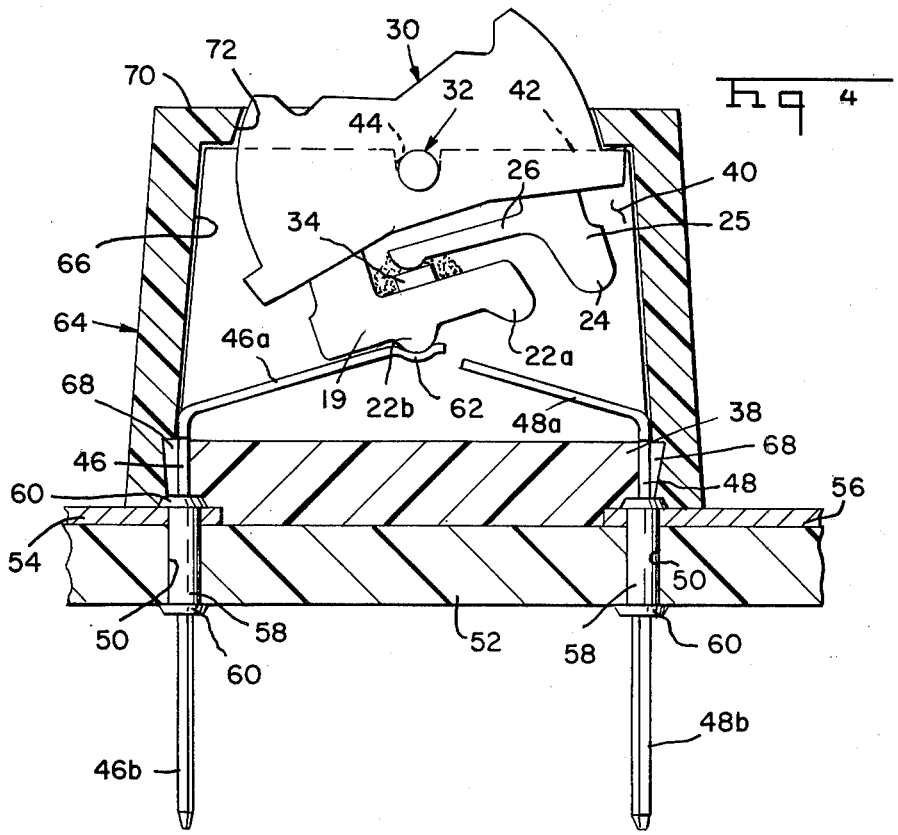
FIG. 4 is an enlarged elevation in section similar to FIG. 3 illustrating the switch in a second mode of operation.

A housing 64 having a generally inverted recess 66 is latchably secured to the side portions 68 of the base 38 retaining the terminals 46 and 48 in position between the base and the cover 64. An adhesive may also be utilized to secure the cover and the base portion together. The cover 64 has a top wall 70 having enlarged slots 72 therein through which corresponding knobs 30 of the subassembly heretofore described project. With the knob 30 of a selected switch in its position shown in FIG. 3, the contact portion 22 of contact 19 will engage and compress the terminal **46*a* and will be detented in the arcuate portion 62. The contact 46*a* will be resiliently deflected in cantilever fashion by its engagement with the contact 19 to assure good electrical connection therewith. The contact portion 24 of contact 25 will engage and compress the terminal 48*a*, resiliently deflecting the terminal in cantilever fashion to establish good electrical contact therewith. Accordingly a circuit path will be completed from the circuit path 54 to terminal 46, through contact 19, across the diode 34, through contact portion 26, through terminal 48*a* and through circuit path 56; with the diode 34 controlling the current direction of said circuit path in the well known operation of a diode. FIG. 4 illustrates an alternative position of the knob 30 which is obtained by rotating the knob, or more particularly, by pivoting the knob about its axle 32. In this position the contact portion 24 of the contact 25 will be disengaged from the terminal portion 48*a* of the terminal 48 thereby interrupting the circuit path heretofore described. In this position the knob, the contact portion 22*a* will be disengaged from the terminal portion 46*a* and the contact portion 22*b* of the contact 19 will be pivoted to engage and detent in the arcuate portion 62. Accordingly the knob 30 may be detented in either of two positions either interrupting or completing a circuit path as described with the diode 34 controlling the direction of current flow or serving to isolate the voltages of undesired polarities from a circuit path which is established across the terminals 46 and 48**. The C shape of the contacts resist collapse from compression during switch operation.

Figure 5:
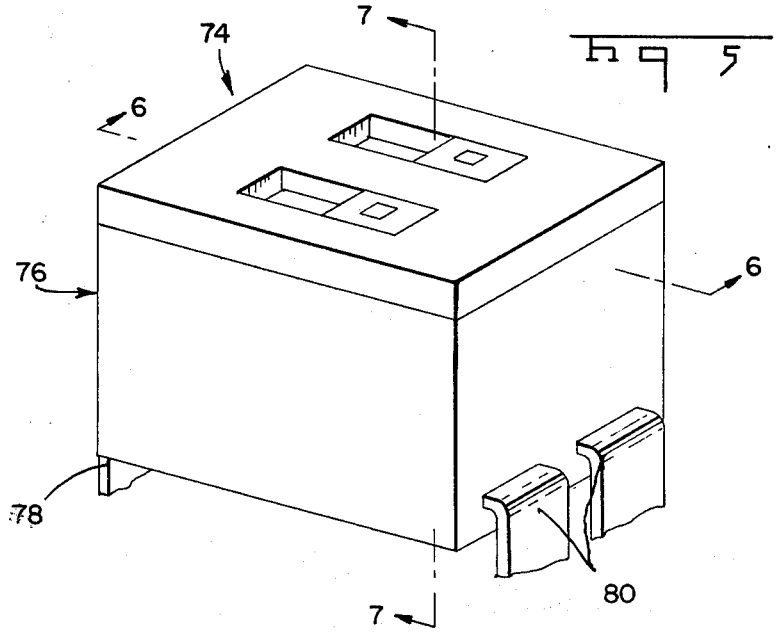
FIG. 5 is an enlarged fragmentary perspective of an alternative embodiment of a switch according to the present invention.
Figure 6:
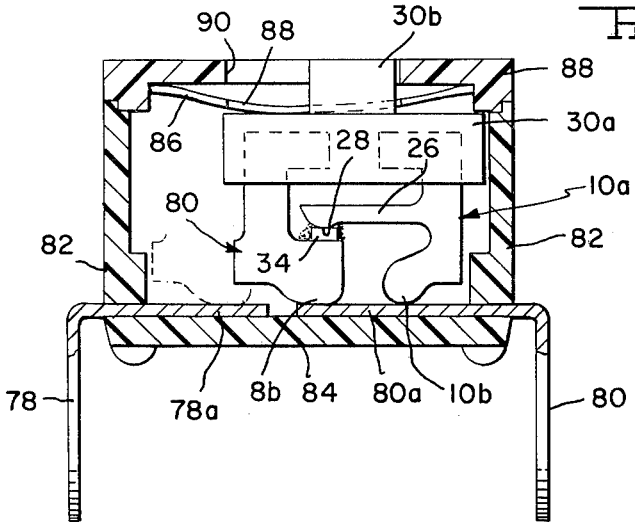
FIG. 6 is an enlarged section taken along the line 6—6 of FIG. 5.
Figure 7:
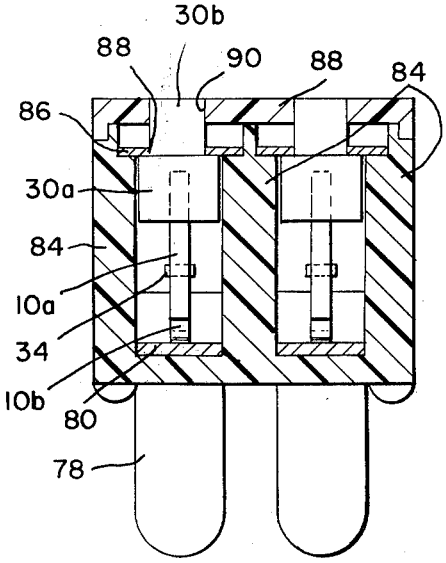
FIG. 7 is an enlarged section taken along the line 7—7 of FIG. 5.

With reference to FIGS. 5, 6 and 7 a slide switch according to the present invention will be described in detail. A switch illustrated generally at 74 includes a housing portion 76 having opposed pairs of terminals 78 and 80. The terminals 78 and 80 may be molded directly into the corresponding sidewalls 82 of the housing. The first end portions **78*a* and 80*a* overlie the bottom wall 84 of the housing and are in alignment with each other. The switch further is provided with a subassembly of contacts 8*a* and 10*a*. Contact 8*a* is generally C-shaped and similar to the contact 8 of the previous embodiment and is provided further with a single depending arcuate portion 8*b*. Contact 10*a* is generally of reversed F configuration and is provided with a single depending arcuate portion 10*b*. The contact 10*a* further includes the resilient beam portion 26 the same as the previous embodiment with a diode 34 in gripped position between the arcuate portion 28 of the beam portion 26 and the portion of the contact 8***a* from which the portion 8*b* depends. A knob or operator 30*a* is fabricated from dielectric material and is in the form of a rectangular block portion in which the top portions of the contacts 8*a* and 10*a* are embedded. The knob 30*a* is provided with a central reduced retangular portion 30*b*. The subassembly of the knob 30*a* and the contacts 8*a* and 10*a* and the diode 34 may be fabricated as previously described. Each subassembly together with a corresponding pair of terminals 70 and 80 are assembled between spaced pairs of partitions 84. Each subassembly further is provided thereover with a bow shaped leaf spring 86 having a slot 88 slidably receiving the knob projecting portion 30*b* of a corresponding knob therein. The ends of the spring 86 overlie corresponding pairs of partitions 84. A cover 88 overlies the housing and is joined by any well known manner to the sidewalls 82 and each of the partitions 84. Each knob 30*b* is slidably received within an aperture 90 provided in the cover. In practice the switch will have its terminals 78 and 80 respectively connected in a circuit path. In the position as shown in FIG. 6 the switch will interrupt a circuit path desired to be connected from the terminal 78 through the switch contacts and through the terminal 80. When the knob 30*a* is displaced from right to left as shown in the figure the contact portion 8*b* will engage the terminal portion 78*a*. The spring 86 will apply downward pressure on the knob 30*a* to insure compression of the contact portion 8*b* on the terminal portion 78*a* and to insure compression of the contact portion 10*b* on the terminal portion 80*a* whereby an electrical circuit will be completed through the terminal 78*a*, through the terminal 8*a*, through the diode 34, through the contact portions 26 and 10*b* and through the terminal 80. The C-shape of the contacts resist collapse due to compression as described. It should be understood that the subassembly comprising the contacts 8*a* and 10*a*, the knob 30*a* and the diode 34*a* may be fabricated in a sequence of operations as heretofore described in conjunction with FIG. 1.

Although preferred embodiments of the present invention are shown and described in detail other embodiments and modification thereof are intended to be covered by the scope and spirit of the appended claims.

What is claimed is:

1. A method for fabricating a switch operator incorporating a diode, comprising the steps of:

stamping and forming opposed pairs of electrical contacts in serial arrangement along the carrier strip, embedding each of said pairs of contacts within a corresponding dielectric knob, press fitting a diode between each of said pairs of contacts, and adhering said contacts to said diode.

2. The method as recited in claim 1, and further including the steps of:

encapsulating each diode with an encapsulant material, and filling the clearances between said diodes and corresponding pairs of said contacts with encapsulant material.

3. The method as recited in claim 1, wherein, said step of embedding each of said pairs of contacts further includes the step of molding each said knobs of dielectric material directly onto a corresponding pair of said contacts.

4. The method as recited in claim 1, wherein, said step of embedding each of said pairs of contacts further includes the step of adhesively embedding each of said pairs of contacts with a corresponding dielectric knob.

5. The method as recited in claim 1, wherein, said step of stamping and forming comprises the step of forming C-shaped configurations on each of said contacts, and wherein, said step of press fitting a diode between each of said pairs of contacts further includes the step of press fitting each said diode between adjacent C-shaped configurations of a corresponding pair of contacts.

* * * * *